US006453685B2

(12) United States Patent
Ota et al.

(10) Patent No.: US 6,453,685 B2
(45) Date of Patent: Sep. 24, 2002

(54) CONTROL APPARATUS AND CONTROL METHOD FOR VARIABLE DISPLACEMENT COMPRESSOR

(75) Inventors: Masaki Ota; Kazuya Kimura; Masahiro Kawaguchi; Ken Suitou; Ryo Matsubara; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/777,596

(22) Filed: Feb. 6, 2001

(30) Foreign Application Priority Data

Feb. 7, 2000 (JP) ..... 2000-029549

(51) Int. Cl.[7] ..... F25B 1/00; F25B 49/00
(52) U.S. Cl. ..... 62/115; 62/227; 62/228.3
(58) Field of Search ..... 62/115, 227, 228.3, 62/228.5

(56) References Cited

U.S. PATENT DOCUMENTS 4,905,477 A * 3/1990 Taki ..... 62/228.5
5,189,886 A * 3/1993 Terauchi ..... 236/78 D

FOREIGN PATENT DOCUMENTS

JP 404273949 * 9/1992 ..... 62/228.3
JP 406180155 * 6/1994 ..... 62/228.3
JP 6-341378 12/1994 ..... F04B/49/00

* cited by examiner

*Primary Examiner*—William Wayner
(74) *Attorney, Agent, or Firm*—Morgan & Finnegan, LLP

(57) ABSTRACT

An improved control apparatus for controlling the displacement of a variable displacement compressor. A control valve includes an operating rod, which is urged by a force based on a differential pressure between two pressure monitoring points, which are located in a refrigeration circuit. The control valve causes the compressor to seek a target displacement. A computer limits the target displacement when the demand for cooling is decreasing to improve fuel economy and to extend the life of the compressor.

20 Claims, 5 Drawing Sheets

CONTROL APPARATUS AND CONTROL METHOD FOR VARIABLE DISPLACEMENT COMPRESSOR

BACKGROUND OF THE INVENTION

The present invention relates to an apparatus and a method for controlling discharge capacity of a variable displacement compressor of an automotive air conditioner.

Generally, a refrigerant circuit of an automotive air conditioner includes a condenser, an expansion valve, an evaporator, and a compressor. The compressor draws and compresses refrigerant gas from the evaporator and discharges the refrigerant gas to the condenser. The evaporator transfers heat to refrigerant passing through the refrigerant circuit from air flowing inside a vehicle. Since the heat of the air passing through the evaporator is transmitted to the refrigerant passing through the evaporator in accordance with the size of the air conditioning load, the pressure of the refrigerant gas at the outlet, or downstream end of the evaporator, reflects the size of the air conditioning load.

A swash plate type variable displacement compressor, which has been widely used in vehicles, is provided with a capacity control mechanism, which is operated to hold the pressure of the outlet of the evaporator (hereinafter referred to as the suction pressure (Ps)) to a predetermined target value (hereinafter referred to as the set suction pressure). The capacity control mechanism feedback controls the discharge capacity of the compressor, or the angle of the swash plate, using the suction pressure Ps as a control index such that the flow rate of the refrigerant corresponds to the size of the air conditioning load. A typical example of a capacity control mechanism is an internal control valve. The internal control valve detects the suction pressure Ps with a pressure-sensing member, such as bellows or a diaphragm, and adjusts the pressure (the crank pressure) of a swash plate chamber (or crank chamber) by using displacement of the pressure-sensing member to position a valve body. The position of the valve body determines the angle of the swash plate.

In addition, since a simple internal control valve, which reacts only to the suction pressure, is not able to cope with a demand for minute air conditioning control, a set suction pressure variable type control valve in which the set suction pressure can be changed by external electric control, is needed. For example, a set suction pressure variable type control valve changes the set suction pressure by using an actuator, the force of which is electrically controllable. For example, the actuator may be an electronic solenoid. The actuator increments or decrements the force acting on the pressure-reducing member, which determines the set suction pressure of the internal control valve.

However, in controlling the discharge capacity using an absolute value of the suction pressure as an index, the real suction pressure cannot reach the set suction pressure immediately, even though the set suction pressure is changed electrically. In other words, whether the actual suction pressure follows the change of the set suction pressure responsively depends on the heat load of the evaporator. Therefore, though the set suction pressure is gradually adjusted by the electric control, the change of the discharge capacity of the compressor is delayed or the discharge capacity is not changed continuously and smoothly, and the change of the discharge capacity often becomes rapid.

SUMMARY OF THE INVENTION

An objective of the present invention is to provide a control apparatus and a control method of a variable displacement compressor which can improve the control property and responsivity of the discharge capacity.

In accordance with one aspect of the present invention, there is provided a control apparatus for controlling discharge capacity of a variable displacement compressor included in a refrigeration circuit of an air conditioner, said refrigeration circuit including an evaporator, said control apparatus comprising: a differential pressure detector for detecting a differential pressure between two pressure monitoring points set to said refrigeration circuit, on which the discharge capacity of the variable displacement compressor is reflected; a temperature sensor for detecting a cooling state of said evaporator as temperature information; a set differential pressure calculator for calculating a set differential pressure which becomes a control target of a differential pressure between the two pressure monitoring points, based on a temperature detected by the temperature sensor of said evaporator and a target temperature which is a control target of the temperature of said evaporator; a limit value setting device for setting a limit value to the differential pressure between the two pressure monitoring points when the temperature detected by the temperature sensor of said evaporator is lowered from the state higher than a threshold temperature which is set to higher than the target temperature to the state lower than the threshold temperature, and for releasing the setting of the limit value when the temperature detected by the temperature sensor of said evaporator is raised from the state lower than the threshold temperature to the state higher than the threshold temperature; a set differential pressure setting device for comparing the set differential pressure calculated by said set differential pressure calculator with the limit value set by said limit value setting device, for dealing with the set differential pressure in itself if the discharge capacity of the variable displacement compressor which the set differential pressure represents is less than that of the variable displacement compressor which the limit value represents, and for dealing with the limit value as a new set differential pressure if the discharge capacity of the variable displacement compressor which the set differential pressure represents is greater than that of the variable displacement compressor which the limit value represents; and a compressor control mechanism for controlling the discharge capacity of the variable displacement compressor so that the differential pressure detected by the differential pressure detector approaches to the set differential pressure from said set differential pressure setting device.

In accordance with another aspect of the present invention, there is provided a method for controlling discharge capacity of a variable displacement compressor included in a refrigeration circuit of an air conditioner, said refrigeration circuit including an evaporator, said method comprising the steps of: detecting a differential pressure between two pressure monitoring points set to said refrigeration circuit, on which the discharge capacity of the variable displacement compressor is reflected; detecting a cooling state of said evaporator as temperature information; calculating a set differential pressure which becomes a control target of a differential pressure between the two pressure monitoring points based on said temperature information and a target temperature which is a control target of the temperature of said evaporator; setting a limit value to the differential pressure between the two pressure monitoring points when said temperature information is lowered from the state higher than a threshold temperature which is set to higher than the target temperature to the state lower than the threshold temperature, and releasing the setting of the limit value when the detected temperature is raised from the state lower than the threshold temperature to the state higher than the threshold temperature; comparing said set differential pressure with the limit value set, dealing with the set differential pressure in itself if the discharge capacity of the variable displacement compressor which the set differential pressure represents is less than that of the variable displacement compressor which the limit value represents, and dealing with the limit value as a new set differential pressure if the discharge capacity of the variable displacement compressor which the set differential pressure represents is greater than that of variable displacement compressor which the limit value represents; and controlling the discharge capacity of the variable displacement compressor so that the differential pressure approaches to said set differential pressure.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

The control apparatus of a swash plate type variable displacement compressor of a refrigeration circuit of an automotive air conditioner according to the present invention will hereafter be described with reference to FIGS. 1 to 5.

The swash plate type variable displacement compressor

Figure 1:
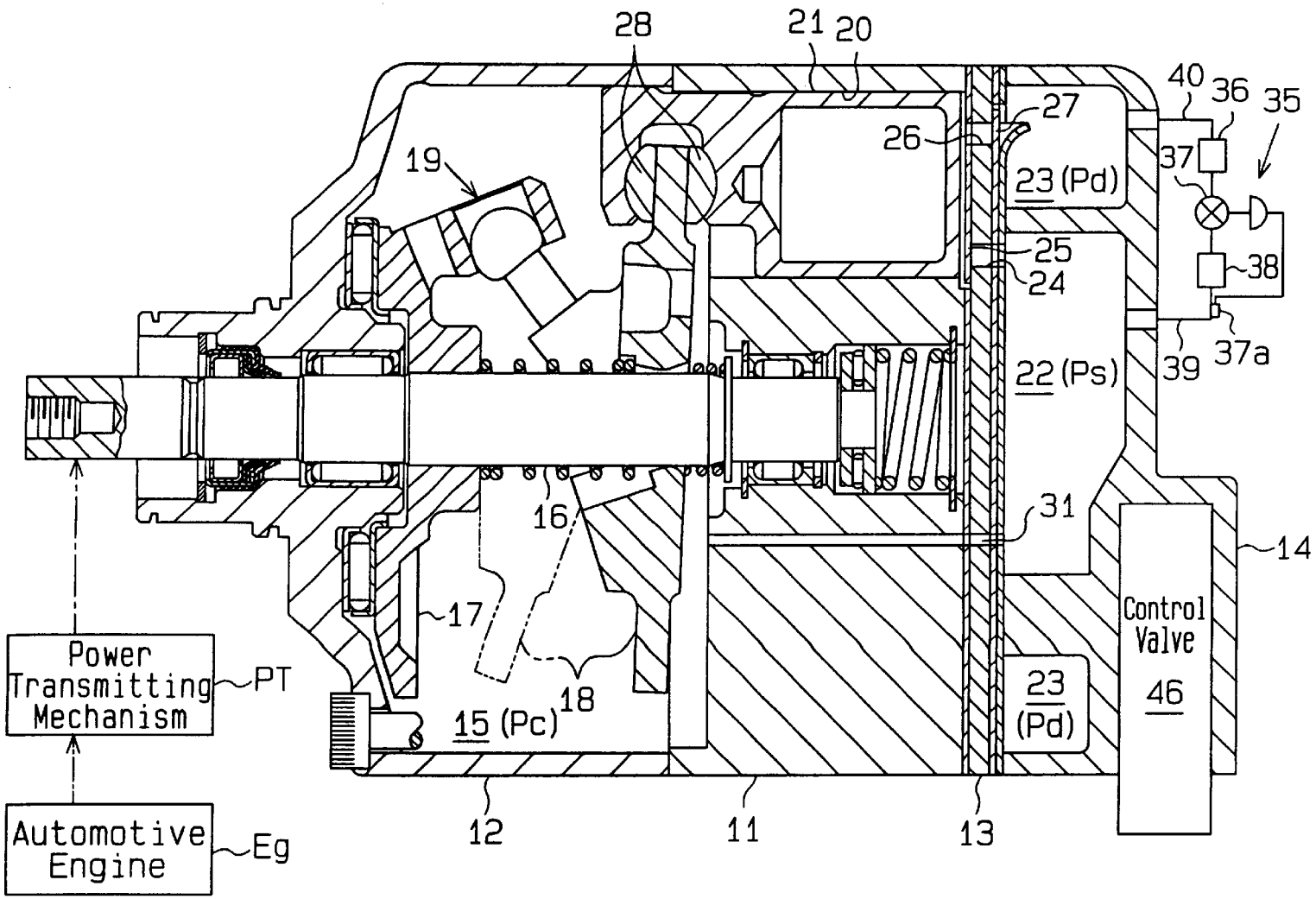
FIG. 1 is a cross-sectional view of a swash plate type variable displacement compressor.

As shown in FIG. 1, the swash plate type variable displacement compressor (hereinafter referred to as the compressor) includes a cylinder block 11, a front housing 12 fixed to the front end of the cylinder block 11, and a rear housing 14 securely fixed to the rear end of the cylinder block 11 through a valve/port forming body 13. A crank chamber 15 is surrounded by the cylinder block 11 and the front housing 12. A drive shaft 16 extends through the crank chamber 15 so that the drive shaft 16 is rotatably supported by the cylinder block 11 and the front housing 12. A lug plate 17 is integrally and rotatably fixed to the drive shaft 16 in the crank chamber 15.

The front end of the drive shaft 16 is operatively connected to an automotive engine Eg, which functions as an external drive source, through a power transmitting mechanism PT. The power transmitting mechanism PT may be a clutch mechanism (for example, an electronic clutch), which can engage and disengage the clutch electronically or it may be a clutchless mechanism, which does not have a clutch mechanism (for example, the transmission may be a combination of a belt and a pulley). In the present invention, a clutchless type power transmitting mechanism PT is used.

The swash plate 18, which functions as a cam plate, is accommodated in the crank chamber 15. The swash plate 18 slides on the surface of the drive shaft 16 in the axial direction, and the swash plate 18 inclines with respect to the axis of the drive shaft 16. A hinge mechanism 19 is located between the lug plate 17 and the swash plate 18. Accordingly, the swash plate 18 is driven integrally with the lug plate 17 and the drive shaft 16 by the hinge mechanism 19.

Cylinder bores 20 (only one cylinder bore is shown) are arranged about the drive shaft 16 in the cylinder block 11. A single-head type piston 21 is accommodated in each cylinder bore 20. The front and rear openings of the cylinder bores 20 are closed by the valve/port forming body 13 and the piston 21, and a compression chamber, the volume of which is changed in accordance with the piston motion is defined in each cylinder bore 20. Each piston 21 is connected to the periphery of the swash plate 18 through a set of shoes 28. Accordingly, rotation of the swash plate 18 by the rotation of the drive shaft 16 is converted to reciprocation of the pistons 21 by the shoes 28.

A suction chamber 22, which is included in a suction pressure Ps region and a discharge chamber 23, which is included in a discharge pressure Pd region, are defined by the valve/port forming body 13 and the rear housing 14, as shown in FIG. 1. Also, when the piston 21 moves from top dead center to bottom dead center, the refrigerant gas of the suction chamber 22 is drawn into the corresponding cylinder bore 20 (compression chamber) through a corresponding suction port 24 and a corresponding suction valve 25 of the valve/port forming body 13. The refrigerant gas drawn into the cylinder bores 20 is compressed to a predetermined pressure by movement of the pistons 21 from bottom dead center to top dead center and is then discharged to the discharge chamber 23 through the discharge ports 26 and the discharge valves 27 of the valve/port forming body 13.

The angle of inclination of the swash plate 18 (the angle formed between the swash plate 18 and an imaginary plane that is perpendicular to the drive shaft 16) can be adjusted by changing the relationship between internal pressure (crank pressure Pc) of the crank chamber 15, which is the back pressure of the pistons 21, and the internal pressure of the cylinder bores 20 (compression chambers). In the present embodiment, the angle of inclination of the swash plate 18 is adjusted by changing the crank pressure Pc.

The refrigeration circuit

Figure 2:
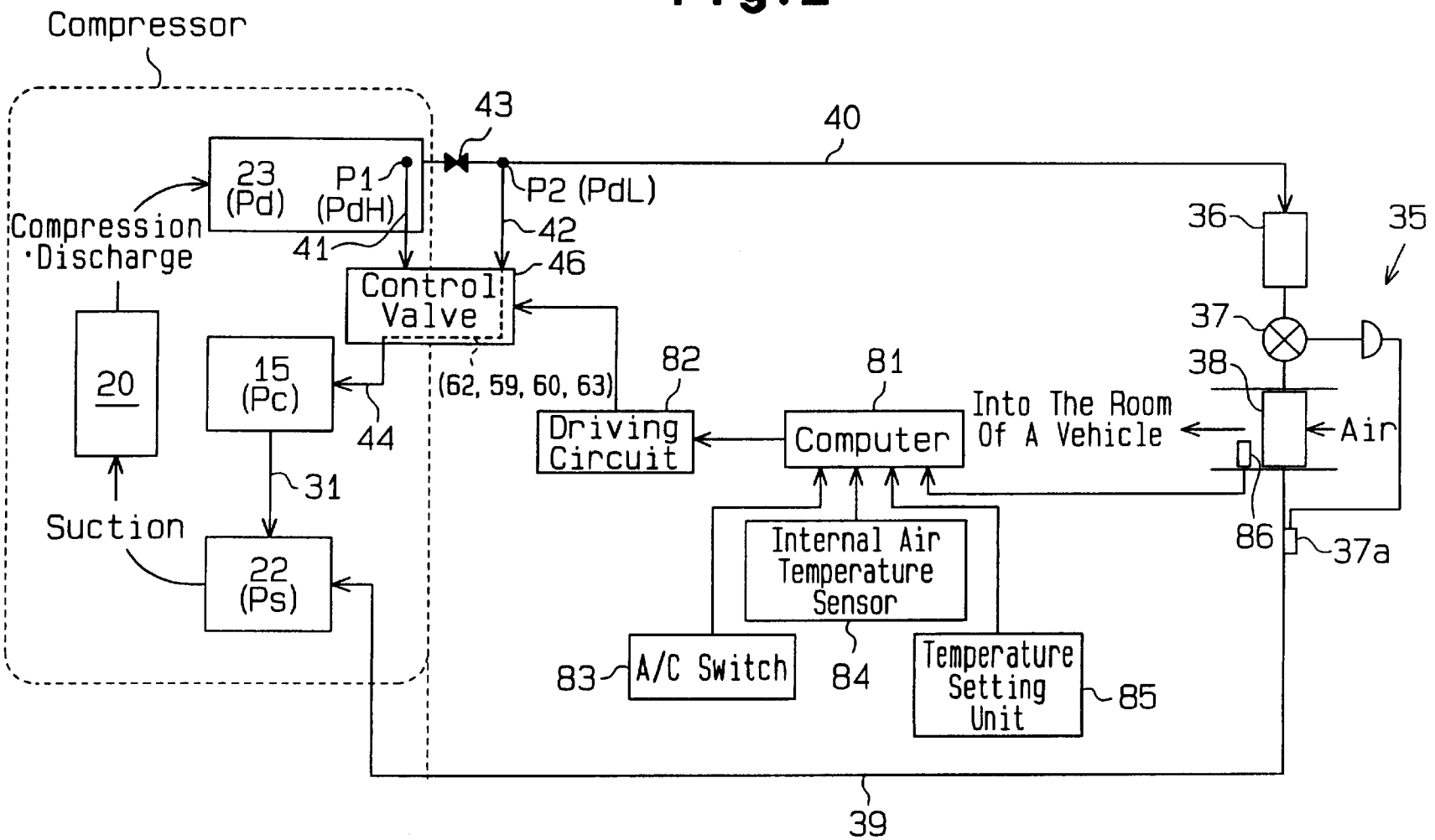
FIG. 2 is a diagram schematically showing a refrigeration circuit.

As shown in FIGS. 1 and 2, the refrigeration circuit of the automotive air conditioner includes the compressor and a external refrigerant circuit 35. The external refrigerant circuit 35 includes a condenser 36, a thermostatic expansion valve 37, and an evaporator 38. The opening degree of the expansion valve 37 is feedback controlled based on an evaporation pressure (the discharge pressure of the evaporator 38) and the temperature detected by a temperature sensor 37*a* placed at the outlet side, or the downstream side, of the evaporator 38. The expansion valve 37 supplies the evaporator 38 with liquid refrigerant, the pressure of which corresponds to the heat load, and adjusts the flow rate of the refrigerant in the external refrigerant circuit 35. A downstream pipe 39 connects the suction chamber 22 of the compressor with the outlet of the evaporator 38 in the downstream region of the external refrigerant circuit 35. An upstream pipe 40 connects the discharge chamber 23 of the compressor with the inlet of the condenser 36 in the upstream region of the external refrigerant circuit 35. The compressor draws and compresses the refrigerant gas from the downstream region of the external refrigerant circuit 35 to the suction chamber 25 and discharges the compressed gas to the discharge chamber 23 connected to the upstream region of the external refrigerant circuit 35.

However, as the flow rate of the refrigerant flowing through the refrigerant circulator is increased, the pressure loss per unit length of the circuit, or the pipe, is also increased. That is, the pressure loss (differential pressure) between a first pressure monitoring point P1 and a second pressure monitoring point P2 in the refrigerant circuit correlates with the flow rate of the refrigerant in the refrigerant circulator. Accordingly, to detect the difference (PdH-PdL) between the gas pressure (PdH) of the first pressure monitoring point P1 and the gas pressure (PdL) of the second pressure monitoring point P2, the flow rate of the refrigerant in the refrigerant circuit must be indirectly detected. In the present embodiment, the first pressure monitoring point P1 (the high pressure point) is any point in the discharge chamber 23 corresponding to the most upstream region of the upstream pipe 40. The second pressure monitoring point P2 (the low pressure point) is a point in the upstream pipe 40 that is spaced from the first pressure monitoring point by a predetermined distance.

In addition, the flow rate of the refrigerant in the following refrigerant circuit can be represented as the product of the rotating speed of the drive shaft 16 and the discharge amount (the discharge capacity) of the refrigerant gas per unit rotation of the drive shaft 16 in the compressor. The rotating speed of the drive shaft 16 can be calculated from the pulley rate of the power transmitting mechanism PT and the rotating speed of the automotive engine Eg (the output shaft). In other words, when the rotating speed of the automotive engine Eg is constant, the flow rate of the refrigerant in the refrigerant circuit is increased when the discharge capacity of the compressor is increased, and the flow rate of the refrigerant in the refrigerant circuit is decreased when the discharge capacity of the compressor is decreased. On the contrary, when the discharge capacity of the compressor is constant, the flow rate of the refrigerant in the refrigerant circuit is increased when the rotating speed of the automotive engine Eg is increased, and the flow rate of the refrigerant in the refrigerant circulator is decreased when the rotating speed of the automotive engine Eg is decreased.

A fixed throttle 43 is arranged between the pressure monitoring points P1 and P2 in the upstream pipe 40. The throttle 43 increases the differential pressure between the points P1 and P2. The fixed throttle 43 increases the differential pressure PdH-PdL between the two points P1 and P2, though the pressure monitoring points P1 and P2 are not far apart from each other. Since the fixed throttle 43 is located between the pressure monitoring points P1, P2, the second pressure monitoring point P2 can be positioned in the vicinity of the compressor (the discharge chamber 23), and a second detecting passage 42, which extends between a control valve 46 mounted in the compressor and the second pressure monitoring point P2, can be shortened.

The crank pressure control mechanism

As shown in FIGS. 1 and 2, the crank pressure control mechanism, for controlling the crank pressure Pc of the compressor, includes a release passage 31, a first pressure sensing passage 41, a second pressure sensing passage 42, a supply passage 44, a control valve 46. The release passage 31 communicates the crank chamber 15 with the suction chamber 22. The first pressure sensing passage 41 connects the first pressure monitoring point P1 of the refrigerant circuit with the control valve 46. The second pressure sensing passage 42 connects the second pressure detecting point P2 of the refrigerant circuit with the control valve 46. The supply passage 44 connects the control valve 46 with the crank chamber 15.

By adjusting the opening degree of the control valve 46, the relationship between the flow rate of high pressure discharge gas flowing from the second pressure monitoring point P2 to the crank chamber 15 through the second pressure sensing passage 42 and the supply passage 44 and the flow rate of gas discharged from the crank chamber 15 to the suction chamber 22 through the release passage 31 is controlled, which determines the crank pressure Pc. The difference between the internal pressure of the cylinder bores 20 and the crank pressure Pc varies in accordance with variation of the crank pressure Pc, and the inclination of the swash plate 18 varies accordingly. The stroke of each piston 21, of the discharge capacity, is adjusted in accordance with the inclination angle of the swash plate 18.

The control valve

Figure 3:
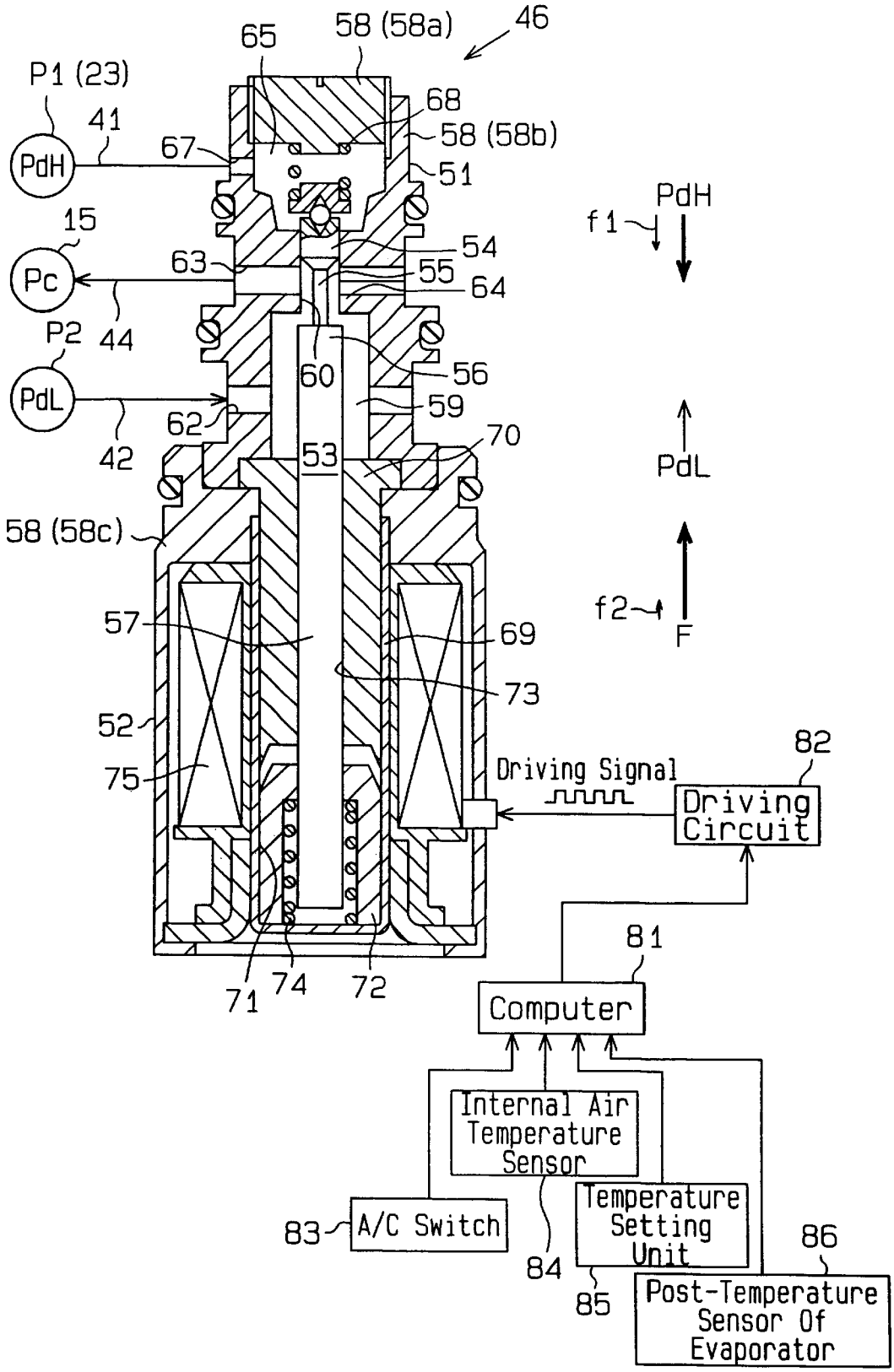
FIG. 3 is a cross-sectional view of a control valve.

As shown in FIG. 3, the control valve 46 includes an inlet valve portion 51 at the top and a solenoid portion 52 at the bottom. The solenoid portion 52 is also called an electric drive portion. The valve portion 51 adjusts the opening degree (throttling amount) of the supply passage 44. The solenoid portion 52 is an electronic actuator for controlling an operating rod 53, which is arranged in the control valve 45, based on external electric current control. The operating rod 53 includes a divider portion 54, a connecting portion 55, a valve portion 56, or valve body, and a guiding rod portion 57. The valve portion 56 is located at the upper end of the guiding rod portion 57.

A valve housing 58 of the control valve 46 includes a cap 58*a*, an upper body 58*b*, which forms a main outer wall of the inlet valve portion 51, and a lower body 58*c*, which forms a main outer wall of the solenoid portion 52. A valve chamber 59 and a communicating passage 60 are formed in the upper body 58*b* of the valve housing 58. A high pressure chamber 65 is formed between the upper body 58*b* and the cap 58*a*, which is threaded to the upper body 58*b*. The operating rod 53 is arranged to move in the valve chamber 59, the communicating passage 60, and the high pressure chamber 65 in an axial direction of the valve housing 58. The valve chamber 59 and the communicating passage 60 can communicate in accordance with the position of the operating rod 53.

A bottom wall of the valve chamber 59 is provided by a top end surface of a fixed core 70 of the solenoid portion 52. A first radial port 62 extends through the main wall of the valve housing 58 surrounding the valve chamber 59. The first radial port 62 connects the valve chamber 59 with the second pressure monitoring point P2 through the second pressure sensing passage 42. Accordingly, the low pressure PdL of the second monitoring point P2 is applied to the valve chamber 59 through the second pressure sensing passage 42 and the first port 62. A second port 63 is arranged to extend radially through the main wall of the valve housing 58 surrounding the communication passage 60. The second port 63 connects the communicating passage 60 with the crank chamber 15 through the supply passage 44. Accordingly, the valve chamber 59 and the communicating passage 60 form a part of the supply passage 44 that passes through the control valve and applies the pressure of the second pressure monitoring point P2 to the crank chamber 15.

The valve portion 56 of the operating rod 53 is located in the valve chamber 59. The diameter of the aperture of the communicating passage 60 is larger than that of the connecting portion 55 of the operating rod 53 so that gas flows smoothly. A step located at the boundary between the communicating passage 60 and the valve chamber 59 functions as a valve seat 64, and the communicating passage 60 is a valve aperture. When the operating rod 53 moves from the location shown in the drawings (the lowest position) to the highest position, where the valve portion 56 is seated against the valve seat 64, the communicating passage 60 is blocked. In other words, the valve portion 56 of the operating rod 53 can adjust the opening degree of the supply passages 44.

The divider portion 54 of the operating rod 53 is fitted into the high pressure chamber 65. The divider portion 54 serves as a partition between the high pressure chamber 65 and the communicating passage 60. Therefore the high pressure chamber 65 does not communicate with the communicating passage 60 directly.

A third port 67 is formed in the main wall of the valve housing 58 surrounding the high pressure chamber 65. The high pressure chamber 65 always communicates with the discharge chamber 23, which is the location of the first pressure monitoring point P1, through the third port 67 and the first pressure sensing passage 41. Accordingly, the high pressure PdH is applied to the high pressure chamber 65 through the first pressure sensing passage 41 and the third port 67. A return spring 68 is accommodated in the high pressure chamber 65. The return spring 68 applies axial force to the divider portion 54 (or to the operating rod 53).

The solenoid portion 52 includes a cylindrical barrel 69 having a bottom. The fixed core 70 is fitted into the top portion of the barrel 69, and the barrel 69 forms a plunger chamber 71. A plunger (the moving core) 72 is accommodated in the plunger chamber 71 and is moveable in the axial direction. A guiding hole 73 is formed in the fixed core 70. The guiding rod portion 57 of the operating rod 53 is fitted in the guiding hole 73 and is moveable in the axial direction. A clearance (not shown) is formed between the internal wall surface of the guiding hole 73 and the guiding rod portion 57. Thus, the valve chamber 59 always communicates with the plunger 71 through the clearance. In other words, the low pressure of the valve chamber 59, that is, the pressure PdL of the second pressure monitoring point P2, is applied to the plunger chamber 71.

The lower end of the guiding rod portion 57 is fixed to the plunger 72. Accordingly, the operating rod 53 moves integrally with the plunger 72. A buffer spring 74 is located in the plunger chamber 71. The elastic force of the buffer spring 74 urges the plunger 72 toward the fixed core 70, which urges the operating rod 53 in an upward direction in the drawings. The force of the buffer spring 74 is smaller than that of the return spring 68.

A coil 75 is wound in the vicinity of the plunger 72 and the fixed core 70 in a range that covers them. The coil 75 is supplied with a driving signal from a driving circuit 82, based on a command from a computer 81, and the coil 75 generates an electronic force F, the magnitude of which depends on the level of the driving signal. The plunger 72 is attracted to the fixed core 70 by the electronic force F, and the operating rod 53 moves upward. The current flowing to the coil 75 is varied by adjusting the voltage applied to the coil 75. In the present embodiment, to adjust the voltage applied to the coil 75, a duty control method has been employed.

In addition, the high pressure PdH of the high pressure chamber 65 is applied to the operating rod 53 in the downward direction of FIG. 3, as is the force f1 of the return spring 68. Also, the low pressure PdL is applied to the guide rod portion 57 in the upward direction. The control valve 46 includes a differential pressure sensor (the pressure chamber 65, the plunger chamber 71, and the operating rod 53), which uses the differential pressure ΔP (ΔPd=(PdH−PdL)) to determine the position of the valve portion 56. On the other hand, the electronic force F generated between the fixed core 70 and the plunger 72 is applied to the operating rod 53 in the upward direction, like the force f2 of the buffer spring 74. In other words, the adjustment of the opening degree of the control valve 46, namely, the adjustment of the opening degree of the communicating passage 60, is internally performed based on changes of the differential pressure between the two points ΔPd, and at the same time, is externally performed based on changes of the electronic force F.

That is, if the electronic force F is constant, when the rotating speed of the engine Eg is decreased to decrease the flow rate of the refrigerant in the refrigerant circuit, the downward force based on the differential pressure between the two points ΔPd is decreased. Thus the downward force acting on the operating rod 53 against the electronic elastic force F is reduced. Accordingly, the operating rod 53 moves upwardly, and the force of the return spring 68 increases. The valve portion 56 of the operating rod 53 is relocated to a position where the upward and downward forces are rebalanced. As a result, the opening degree of the communicating passage 60 is reduced, and the crank pressure Pc is reduced. Consequently, the difference between the internal pressure of the cylinder bores 20 and the crank pressure Pc is reduced, and the angle of the inclination of the swash plate 18 is increased. As a result, the discharge capacity of the compressor is increased. When the discharge capacity of the compressor is increased, the flow rate of refrigerant in the refrigerant circuit is increased, and the differential pressure between the two points ΔPd is increased.

On the contrary, when the rotating speed of the automotive engine Eg is increased to increase the flow rate of the refrigerant in the refrigeration circuit, the downward force based on the differential pressure ΔPd is increased. Accordingly, the operating rod 53 moves downwardly, the downward force of the return spring 68 is reduced, and the valve portion 56 of the operating rod 53 is relocated to a position where the upward and downward forces are rebalanced. As a result, the opening degree of the communicating passage 60 is increased, and the crank pressure Pc is increased. Also, the difference between the internal pressure of the cylinder bores 20 and the crank pressure Pc is increased, and the angle of the inclination of the swash plate 18 is decreased. Thus, the discharge capacity of the compressor is decreased. When the discharge capacity of the compressor is decreased, the flow rate of the refrigerant in the refrigeration circuit is decreased, and the differential pressure ΔPd is decreased.

In addition, for example, if the electronic force F is increased by increasing the duty ratio Dt to the coil 75, the operating rod 53 moves upwardly against the force of the return spring 68, and the valve portion 56 of the operating rod 53 is relocated at a position where the upward and downward forces are rebalanced. Accordingly, the opening degree of the control valve 46, namely, the opening degree of the communicating passage 60 is reduced, and the discharge capacity of the compressor is increased. As a result, the flow rate of the refrigerant in the refrigerant circulator is increased, and the differential pressure ΔPd is also increased.

On the contrary, if the electronic force F is decreased by decreasing the duty ratio Dt, the operating rod 53 moves downwardly and the force of the return spring 68 is reduced. Consequently, the valve portion 56 of the operating rod 53 is relocated at a position where the upward and downward forces on the rod 53 are rebalanced. Accordingly, the opening degree of the communicating passage 60 is increased, and the discharge capacity of the compressor is decreased. As the result, the flow rate of the refrigerant in the refrigerant circulator is decreased, and the differential pressure ΔPd is also decreased.

In other words, the control valve 46 in FIG. 3 positions the operating rod 53 in accordance with the differential pressure ΔPd to hold a control target (the target differential pressure) of the differential pressure ΔPd, which is determined by the electronic force F.

The control scheme

As shown in FIGS. 2 and 3, the automotive air conditioner includes the computer 81, which performs overall control. The computer 81 includes a CPU, a ROM, a RAM, and an I/O interface. The A/C switch 83 (the ON/OFF switch of the air conditioner operated by passengers), an internal air temperature sensor 84 for detecting the temperature of the passenger compartment, a temperature setting unit 85 for setting the compartment temperature, and a post-temperature sensor 86 of the evaporator are connected to the input terminal of the I/O interface of the computer 81. The evaporator air temperature sensor 86 is located in the vicinity of the exit side of the evaporator 38 and detects the temperature of the air cooled by passing through the evaporator 38. A driving circuit 82 is connected to the output terminal of the I/O interface of the computer 81.

The computer 81 calculates an appropriate duty ratio Dt, which indicates the set differential pressure, based on various kinds of external information, which is provided by respective sensors 83–86, and commands the driving circuit 82 to output the driving signal, which represents the duty ratio Dt. The driving circuit 82 outputs the driving signal that represents the commanded duty ratio Dt to the coil 75 of the control valve 46. The electronic force F of the solenoid portion 52 of the control valve 46 is changed in accordance with the duty ratio of the driving signal.

Figure 4:
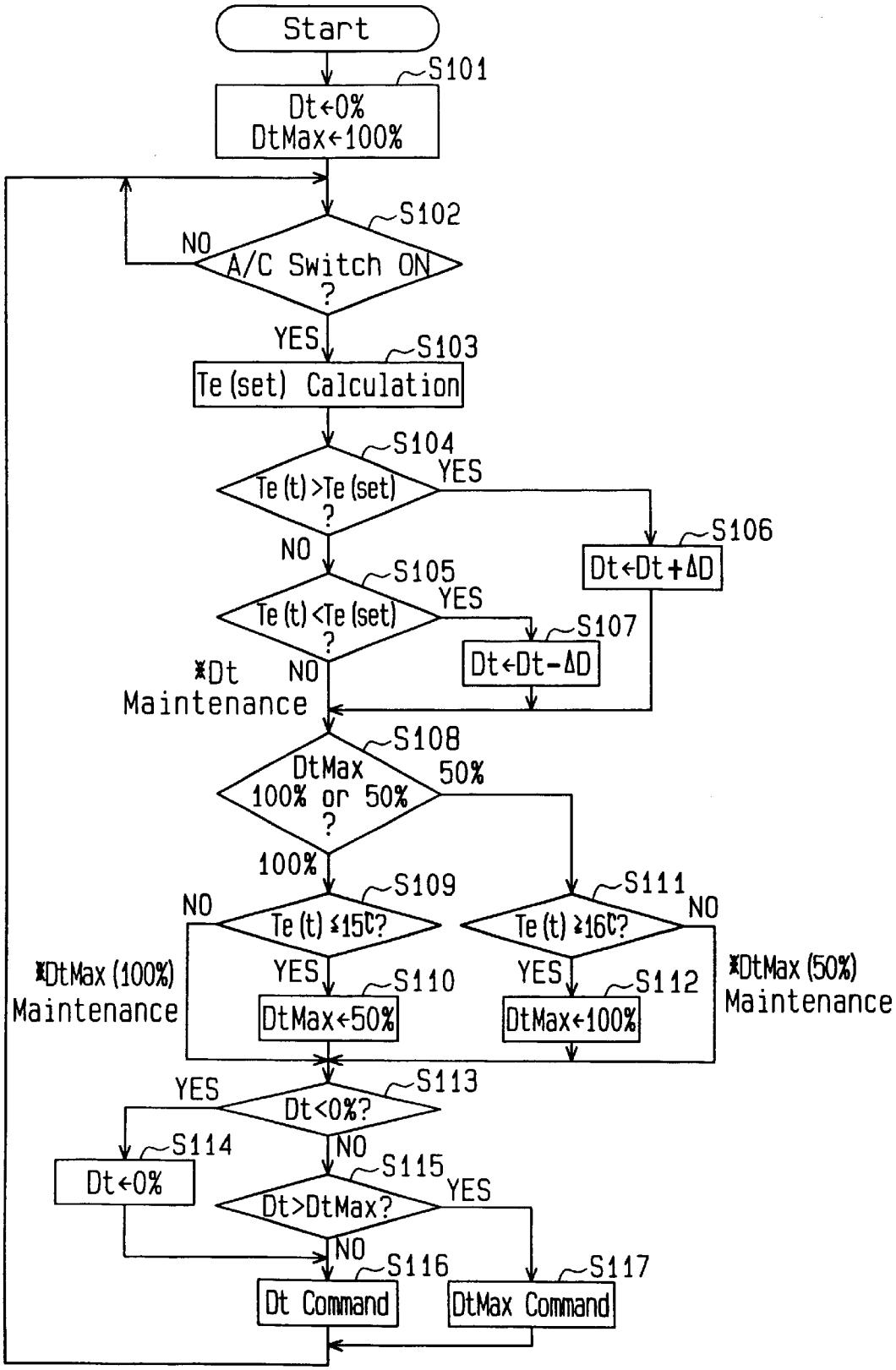
FIG. 4 is a flow chart illustrating a control method of the control valve.

The duty control method of the control valve 46 by the computer 81 will be described hereinafter with reference to the flow chart of FIG. 4.

If an ignition switch (or a start switch) of the vehicle is turned ON, the computer 81 is supplied with power and starts the operating process. In the first step S101 (steps are sometimes referred to as S101 and so on), the computer 81 performs various initialization steps in accordance with an initial program. For example, the duty ratio Dt is initially set to 0%, and the upper limit value DtMax of the duty ratio Dt is set to 100%. By setting the upper limit value DtMax of the duty ratio to 100%, the magnitude of the electronic force F, that is, the set differential pressure, which is used to adjust the valve opening degree of the control valve 46, can be reduced as far as the physical limit of the control valve 46. Also, the upper limit value DtMax is changed between 100% and a value less than 100%, for example, 40–60% (50% in the present embodiment). Setting the upper limit value DtMax to 50% limits the cooling capability of the air conditioner.

In the step S102, the ON/OFF state of the A/C switch 83 is monitored until the A/C switch 83 is turned ON. When the A/C switch 83 is turned ON, in step S103, the computer 81 determines the cooling state of the evaporator 38 based on the set temperature information from the temperature setting unit 85 or the temperature information from the compartment air temperature sensor 84. In other words, a target temperature Te(set) of the evaporator air temperature Te(t) is calculated in the range of 3–12° C. Accordingly, the compartment air temperature sensor 84 and the temperature setting unit 85, together with the computer 81, form a temperature setting device for setting the target temperature the target temperature Te(set).

In step S104, the computer 81 determines whether the temperature Te(t) detected by the evaporator air temperature sensor 86 is greater than the target temperature Te(set). If the determination of the step S104 is NO, the computer 81 determines in step S105 whether the detected temperature Te(t) is less than the target temperature Te(set). If the determination of step S105 is also NO, since the detected temperature Te(t) is equal to the target temperature Te(set), the duty ratio Dt is not changed.

If the determination of step S104 is YES, the computer 81 increases the duty ratio Dt by the unit amount ΔD in step S106. When the driving signal Dt+ΔD is output from the driving circuit 82 to the coil 75 of the control valve 46 as described above, the flow rate of the refrigerant in the refrigerant circulator is increased, and the cooling performance of the evaporator 38 increases, and the evaporator air temperature Te(t) decreases. If the determination of step S105 is YES, the computer 81 decreases the duty ratio Dt by the unit amount ΔD in step S107. When the driving signal Dt−ΔD is output from the driving circuit 82 to the coil 75 of the control valve 46 as described above, the flow rate of the refrigerant in the refrigerant circulator is decreased, the cooling performance of the evaporator 38 decreases, and the evaporator air temperature Te(t) increases.

After the duty ratio Dt is changed in the above-described manner, the computer 81 determines whether the temperature Te(t) detected by the evaporator air temperature sensor 86 is outside of a predetermined threshold temperature range (for example, 15–16° C.) and, if so, changes the upper limit value DtMax of the duty ratio Dt. The threshold temperature range (15–16° C.) is greater than the set range (3–12° C.) of the target temperature Te(set).

That is, in step S108, the computer 81 determines whether the present set upper limit value DtMax is 100% or 50%. If the upper limit value DtMax is determined to 100% in step S108, the computer determines in step S109 whether the temperature Te(t) detected by the evaporator air temperature sensor 86 is less than the lower limit temperature (15° C.) of the threshold temperature range (15–16° C.) If the determination of step S109 is NO, the upper limit value remains at 100%. On the contrary, if the determination of step S109 is YES, the upper limit value DtMax is changed from 100% to 50% in step S110.

In addition, if the upper limit value DtMax is determined to be 50% in step S108, the computer determines in step S111 whether the temperature Te(t) detected by the evaporator air temperature sensor 86 is greater than the upper limit temperature (16° C.) of the threshold temperature range (15–16° C.) . If the determination of step S111 is NO, the upper limit value DtMax remains at 50%. On the contrary, if the determination of step S111 is YES, the upper limit value DtMax is changed from 50% to 100%.

Figure 5:
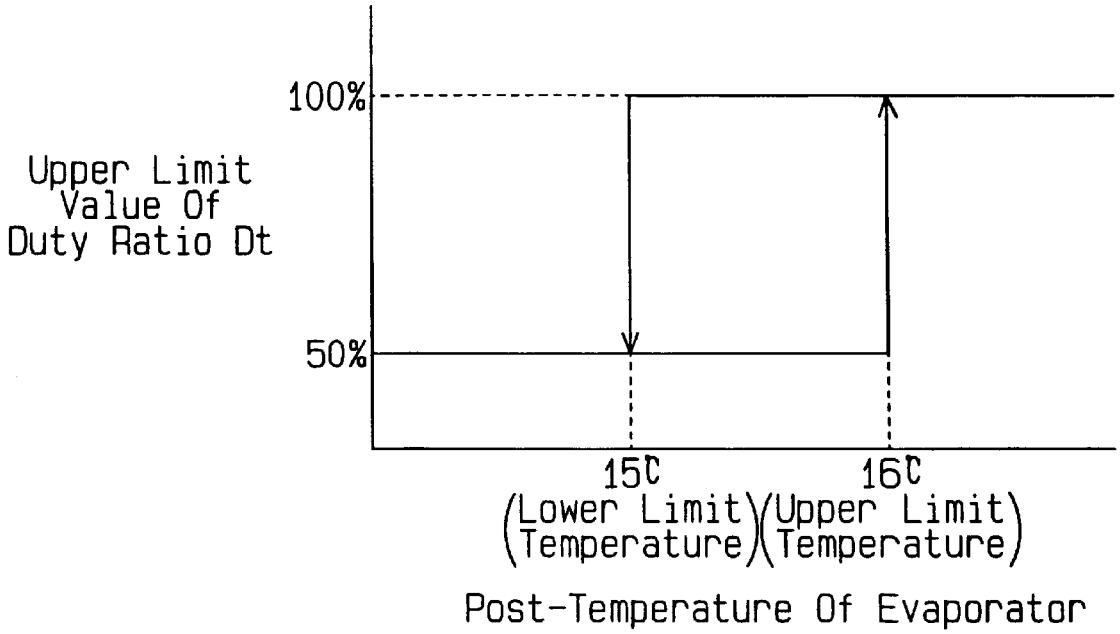
FIG. 5 is a graph showing the relationship between a post-temperature of the evaporator and an upper limit value of a duty ratio.

FIG. 5 graphically shows the processes of steps S108–S112. That is, if the temperature Te(t) detected by the evaporator air temperature sensor 86 falls from a temperature greater than the lower limit temperature (15° C.) of the threshold temperature range (15–16° C.) to a temperature less than the lower limit temperature (15° C.), the computer 81 changes the upper limit value DtMax of the duty ratio Dt from 100% to 50%. In effect, this places an upper limit on the target differential pressure ΔPd. If the temperature Te(t)

detected by the evaporator air temperature sensor 86 increases from a temperature less than the upper limit temperature (16° C.) of the threshold temperature range (15–16° C.) to a temperature greater than the upper limit temperature (16° C.), the computer 81 changes the upper limit value DtMax of the duty ratio Dt from 50% to 100%. In effect, this increases the upper limit of the target differential pressure.

In other words, the computer 81 determines the need for cooling by comparing the temperature Te(t) detected by the evaporator air temperature sensor 86 with the target temperature Te(set) and determines the degree of the cooling load by comparing the detected temperature Te(t) to a limit of the threshold temperature range (15–16° C.) In addition, when the detected temperature Te(t) is less than the lower limit of the threshold temperature range (15–16° C.), the computer determines that there is little or no need for cooling and reduces the upper limit value of the cooling capability. When the detected temperature Te(t) is greater than the upper limit of the threshold temperature range (15–16° C.), the computer determines that the need for cooling is large, and maximizes the cooling capability of the air conditioner by changing the upper limit value of the cooling capability.

In step S113, the computer 81 determines whether the duty ratio Dt calculated by steps S104–S107 is less than 0%. If the determination of step S113 is YES, the computer 81 corrects the duty ratio Dt to 0% in step S114. Further, if the determination of step S113 is NO, the computer 81 determines in step S115 whether the duty ratio Dt calculated by steps S104–107 is greater than the upper limit value DtMax, which may have been re-set by steps S108–112. If the determination of step S115 is NO, the computer 81 sends the duty ratio Dt calculated by steps S104–S107 to the driving circuit 82 in step S116. On the contrary, if the determination of step S115 is YES, the computer 81 sends the upper limit value DtMax to the driving circuit 82 in step S117.

When the upper limit value DtMax is set to 50%, step S115 monitors whether the target differential pressure, which is calculated by steps S104–S107, in the form of the duty ratio, is greater than the upper limit value. However, when the upper limit value DtMax is set to 100%, step S115 monitors only whether the duty ratio Dt is greater than the real range (0–100%) of the driving signal output from the driving circuit 82. For example, if a duty ratio Dt greater than 100% is sent to the driving circuit 82, the set differential pressure is set to the maximum value as when the duty ratio is 100%. In spite of that, the calculation of a duty ratio greater than 100% is not allowed because the set differential pressure continuously remains at the maximum value until the duty ratio falls below 100% if decrease the duty ratio Dt is decreased under the condition that the duty ratio is greater than 100%, thereby degrading the responsivity. This is similar to the case that the duty ratio Dt is less than 0%. Accordingly, the processes of the steps S113 and S114 are provided.

The effects of the illustrated embodiment are as follows.

(1) The feedback control of the discharge capacity of the compressor is done by using the differential pressure ΔPd=PdH−PdL as the direct control target, without using the suction pressure Ps, which is affected by the heat load. Accordingly, regardless of the heat load circumstances, the control of the discharge capacity and the responsiveness are improved.

(2) The operating efficiency of the compressor tends to deteriorate when the piston speed is increased due to friction. The piston speed is related to the rotating speed of the drive shaft 16. The compressor cannot change the rotating speed of the engine Eg because the compressor is driven as an auxiliary unit of the automotive engine Eg. Accordingly, to use the compressor effectively and to improve the efficiency of the engine Eg, the discharge capacity is normally not maximized when the rotating speed of the automotive engine Eg is high. In terms of the protection of the compressor, it is important that the compressor not be in high load state. To protect the compressor, the control valve 46 is designed such that the compressor has the maximum discharge capacity, and the differential pressure between two points (ΔPd=PdH−PdL) resulted from the region where the rotating speed of the automotive engine Eg is less than the high speed region is set to a maximum value of the set differential pressure resulted when the duty ratio is 100%. Then, if the rotating speed of the automative engine Eg enters the high speed region, the differential pressure between two points ΔPd becomes greater than the maximum value of the set differential pressure in case that the discharge capacity becomes the maximum, and then the compressor decreases internally the discharge capacity from the maximum value.

However, in an initial state in which the compartment temperature is high and the evaporator air temperature Te(t) is far greater than the target temperature Te(set), it is necessary that the air conditioner have the maximum cooling capability, regardless of the rotating speed of the automotive engine Eg. Accordingly, the control valve 46 is designed to have a high cooling performance rather than high efficiency during those times. In other words, the control valve 46 is designed such that the compressor has the maximum discharge capacity and the differential pressure between two points ΔPd resulted from the region where the rotating speed of the automotive engine Eg is high is set to the maximum value of the set differential pressure. By the above-mentioned design, though the discharge capacity is the maximum value, the differential pressure between two points (ΔPd=PdH−PdL) is not greater than the maximum value of the set differential pressure unless the rotating speed of the automotive engine Eg is pretty large (actually, by the efficiency deterioration of the compressor, when the rotating speed of the automotive engine Eg enters the high speed region, the flow rate of the refrigerant is limited, and it can be represented to "no matter how high the rotating speed of the automotive engine Eg may be"). Accordingly, the discharge capacity of the compressor must be the maximum if the duty ratio Dt becomes 100%. Therefore, the air conditioner can exhibit the maximum cool capability at that time regardless of the rotating speed of the automotive engine Eg, and can cope with the high cooling load sufficiently.

If the automotive air conditioner of the present embodiment did not performed steps S108–S117 to increase the cooling performance, the following problem occurs. If the air temperature at the evaporator Te(t) is less than the lower limit of the threshold temperature range (15–16° C.), the cooling load decreases and the air temperature at the evaporator Te(t) is decreased to the target temperature Te(set). Therefore, there is no need for the maximum cooling capability at that time.

However, if steps S108–S112 are not performed, a duty ratio Dt of 100% is always allowed. Accordingly, though the air temperature at the evaporator Te(t) is decrease to the vicinity of the target temperature Te(set) and the cooling load is small, there is a problem that the duty ratio Dt may be set to 100% continuously until the air temperature at the evaporator Te(t) is less than the target temperature Te(set). If the duty ratio Dt is set to 100%, when the rotating speed of the automotive engine Eg becomes very high speed region, the discharge capacity of the compressor is maximized by the control valve 46, and the cooling capability continuously maximized. In other words, the compressor is unnecessarily in a high load and inefficient state.

However, when steps S108–S112 are performed, if the air temperature at the evaporator Te(t) is less than the lower limit of the threshold temperature range (15–16° C.), the cooling load is determined to be small, and the duty ratio Dt is set to 50%, even though the air temperature of the evaporator Te(t) has not reached the target temperature Te(set). Accordingly, when the air temperature at the evaporator Te(t) is less than the lower limit of the threshold temperature range (15–16° C.), the target differential pressure does not exceed an upper limit value that corresponds to the duty ratio Dt of 50%. Also, when the set differential pressure (the duty ratio)is set to the upper limit value, if the rotating speed of the automotive engine Eg becomes high, the differential pressure ΔPd will exceed the upper limit value of the target differential pressure when the discharge capacity reaches the maximum value that corresponds to the upper limit value of 50%, and consequently the discharge capacity of the compressor is automatically reduced by the control valve 46. As mentioned, if the compressor avoids a low efficiency and high load state, the operating efficiency of the automotive engine Eg is improved, and fuel consumption is reduced. Also, the compressor can be protected and used for a long time. Also, if, when the rotating speed of the automotive engine Eg becomes very high, the discharge capacity of the compressor (which is related to load torque) does not reach the maximum value, the load of the compressor on the engine Eg is reduced, and the traveling performance and the acceleration performance of the vehicle are improved, and the heat produced by the engine Eg is reduced. Therefore, the size of the cooling unit for cooling the engine (particularly, the heat exchanger) can be reduced.

(3) The present embodiment employs hysteresis such that the air temperature at the evaporator Te(t) when the upper limit value DtMax of the duty ratio Dt is changed from 100% to 50% is different from that Te(t) when the upper limit value DtMax of the duty ratio Dt is changed from 50% to 100%. This is accomplished with the threshold temperature range (15–16° C.). Therefore, by avoiding hunting, which would occur if a single threshold temperature were used, the discharge capacity control of the compressor is stable. Such hunting would change the upper limit value DtMax instantaneously and frequently.

(4) The computer 81 adjusts the target temperature Te(set) of the evaporator air temperature Te(t) based on the temperature indicated by temperature setting unit 85 or the compartment temperature. In other words, the air conditioner can change the cooling state of the evaporator 38 in accordance with the degree of the need for cooling. For example, the air conditioner does not comprise the internal air temperature sensor 84 or the temperature setting unit 85, and can achieve the comfortableness improvement (for instance, the change of the temperature flown into the automotive room is suppressed) of the air conditioner or the power-saving of the compressor in comparison with the composition which the predetermined target temperature Te(set) is maintained. In other words, in this comparative example, the target temperature must be set to the low value to cope with the case that a demand degree for the cooling is the largest (the case that an operator demands the lowest room temperature). Accordingly, the evaporator 38 is unnecessarily cooled even when the demand cooling is small. In addition, in this comparative example, when the demand degree for the cooling is small, the air cooled by passing through the evaporator 38 is reheated suitably by a heater (not shown) using the heat generated by the operation of the automotive engine and then flows into the passenger compartment.

(5) The compressor is a swash plate type variable displacement compressor in which the stroke of the piston 21 can be changed by controlling the pressure Pc of the crank chamber 15. The control unit of the present embodiment is most suitable to capacity control of a swash plate type variable displacement compressor.

In addition, the following are considered to be within the scope of the present invention.

The threshold temperature may be a single temperature.

The temperature of a surface of the evaporator 38 may be directly detected to indicate the cooling state of the evaporator 38.

The internal air temperature sensor 84 or the temperature setting unit 85 may be omitted and the target temperature Te(set) may be set to a fixed value.

The first pressure monitoring point P1 may be in the suction pressure region between the evaporator 38 and the suction chamber 22, and the second pressure monitoring point P2 may be downstream of the first pressure monitoring point P1 in the same suction pressure region.

The first pressure monitoring point P1 may be in the discharge pressure region between the discharge chamber 23 and the condenser 36, and the second pressure monitoring point P2 may be in the suction pressure region between the evaporator 38 and the suction chamber 22.

The first pressure monitoring point P1 may be in the discharge pressure region between the discharge chamber 23 and the condenser 36, and the second pressure monitoring point P2 may be in the crank chamber 15. Alternatively, the first pressure monitoring point P1 may be in the crank chamber 15, and the second pressure monitoring point P2 may be in the suction pressure region between the evaporator 38 and the suction chamber 22. In other words, the pressure monitoring points P1 and P2 are located in the refrigeration circuit. The pressure monitoring points P1, P2 may be in the high pressure region, the low pressure region, or the crank chamber 15. In one embodiment, when the discharge capacity of the compressor is increased, the differential pressure between the two points (ΔPd=Pc−Ps) decreases (which is opposite to the manner of the illustrated embodiment). Accordingly, if the evaporator air temperature Te(t) is less than the lower limit of the threshold temperature range (15–16° C.), the lower limit value is set to the differential pressure ΔPd between the two pressure monitoring points as a limit value. In addition, the set differential pressure determining means 81 compares the set differential pressure calculated by the set differential pressure calculating means with the lower limit value set by the limit value setting means, deals with the set differential pressure in itself if the set differential pressure is more than the lower limit value, and deals with the lower limit value as new set differential pressure if the set differential pressure is less than the lower limit value.

For example, by using the control valve comprising only the electric valve driving element, the pressures PdH, PdL of the two pressure monitoring points P1, P2 are detected by the respective pressure sensor. In this case, the pressure sensor for detecting the pressures PdH, PdL of the each pressure monitoring points P1, P2 forms the differential pressure sensing means.

The control valve may be the extracted side control valve which adjusts the crank pressure Pc by adjusting the opening degree of the charge passage 31, not by adjusting the opening degree of the release passages 42, 44.

The control valve may be a three-way valve that adjusts the crank pressure Pc by adjusting the opening degree of both sides of the release passages 42, 44 and the charge passage 31.

The power transmitting mechanism may include an electronic clutch.

The control apparatus of a wobble type variable displacement compressor is concretized.

What is claimed is:

1. A control apparatus for controlling discharge capacity of a variable displacement compressor included in a refrigeration circuit of an air conditioner, said refrigeration circuit including an evaporator, said control apparatus comprising:

a differential pressure detector for detecting a differential pressure between two pressure monitoring points set to said refrigeration circuit, on which the discharge capacity of the variable displacement compressor is reflected;

a temperature sensor for detecting a cooling state of said evaporator as temperature information;

a set differential pressure calculator for calculating a set differential pressure which becomes a control target of a differential pressure between the two pressure monitoring points, based on a temperature detected by the temperature sensor of said evaporator and a target temperature which is a control target of the temperature of said evaporator;

a limit value setting device for setting a limit value to the differential pressure between the two pressure monitoring points when the temperature detected by the temperature sensor of said evaporator is lowered from the state higher than a threshold temperature which is set to higher than the target temperature to the state lower than the threshold temperature, and for releasing the setting of the limit value when the temperature detected by the temperature sensor of said evaporator is raised from the state lower than the threshold temperature to the state higher than the threshold temperature;

a set differential pressure setting device for comparing the set differential pressure calculated by said set differential pressure calculator with the limit value set by said limit value setting device, for dealing with the set differential pressure in itself if the discharge capacity of the variable displacement compressor which the set differential pressure represents is less than that of the variable displacement compressor which the limit value represents, and for dealing with the limit value as a new set differential pressure if the discharge capacity of the variable displacement compressor which the set differential pressure represents is greater than that of the variable displacement compressor which the limit value represents; and a compressor control mechanism for controlling the discharge capacity of the variable displacement compressor so that the differential pressure detected by the differential pressure detector approaches to the set differential pressure from said set differential pressure setting device.

2. The control apparatus according to claim 1, wherein said threshold temperature comprises an upper limit temperature and a lower limit temperature which are different from each other, wherein said limit value setting device for setting a limit value to the differential pressure between the two pressure monitoring points when the temperature detected by the temperature sensor of said evaporator is lowered from the state higher than the lower limit temperature to the state lower than the lower limit temperature, and for releasing the setting of the limit value when the temperature detected by the temperature sensor of said evaporator is raised from the state lower than the upper limit temperature to the state higher than the upper limit temperature.

3. The control apparatus according to claim 1, wherein said temperature sensor of the evaporator is arranged in the vicinity of the evaporator, and detects the temperature of air passed through the evaporator.

4. The control apparatus according to claim 1, wherein said control apparatus further comprises a temperature setting device which can adjust a target temperature of said evaporator.

5. The control apparatus according to claim 1, further comprising a means for magnifying the differential pressure between the two pressure monitoring points, the means is arranged between the two pressure monitoring points.

6. The control apparatus according to claim 5, wherein said means is a fixed throttle.

7. The control apparatus according to claim 1, wherein said compressor is a swash plate type variable displacement compressor which stroke of a piston can be changed by controlling an internal pressure of a crank chamber.

8. The control apparatus according to claim 1, wherein said compressor is a wobble type variable displacement compressor in which stroke of a piston can be changed by controlling an internal pressure of a crank chamber.

9. A control apparatus for controlling discharge capacity of a variable displacement compressor included in a refrigeration circuit of an air conditioner, said refrigeration circuit including an evaporator, said control apparatus comprising:

a compressor control mechanism for controlling the discharge capacity of the compressor in accordance with a differential pressure between two pressure monitoring points set to said refrigeration circuit, said differential pressure reflecting the discharge capacity of the variable displacement compressor;

a temperature sensor for detecting a cooling state of said evaporator as temperature information; and a computer for calculating a set differential pressure which becomes a control target of a differential pressure between the two pressure monitoring points, based on a temperature detected by the temperature sensor of said evaporator and a target temperature which is a control target of the temperature of said evaporator, wherein said compressor control mechanism controls the discharge capacity of the variable displacement compressor so that the differential pressure approaches to the set differential pressure, wherein said computer sets a limit value to the differential pressure between the two pressure monitoring points when the temperature detected by the temperature sensor of said evaporator is lowered from the state higher than a threshold temperature, which is set to higher than the target temperature, to the state lower than the threshold temperature, and releases the setting of the limit value when the temperature detected by the temperature sensor of said evaporator is raised from the state lower than the threshold temperature to the state higher than the threshold temperature, wherein said computer compares the set differential pressure with the limit value when the limit value is set, deals with the set differential pressure in itself if the discharge capacity of the variable displacement compressor which the set differential pressure represents is less than that of the variable displacement compressor which the limit value represents, and deals with the limit value as a new set differential pressure if the discharge capacity of the variable displacement compressor which the set differential pressure represents is greater than that of the variable displacement compressor which the limit value represents.

10. The control apparatus according to claim 9, wherein said threshold temperature comprises an upper limit temperature and a lower limit temperature which are different from each other, wherein said computer sets a limit value to the differential pressure between the two pressure monitoring points when the temperature detected by the temperature sensor of said evaporator is lowered from the state higher than the lower limit temperature to the state lower than the lower limit temperature, and releases the setting of the limit value when the temperature detected by the temperature sensor of said evaporator is raised from the state lower than the upper limit temperature to the state higher than the upper limit temperature.

11. The control apparatus according to claim 9, wherein said temperature sensor of the evaporator is arranged in the vicinity of the evaporator, and detects the temperature of air passed through the evaporator.

12. The control apparatus according to claim 9, wherein said control apparatus further comprises a temperature setting device which can adjust the target temperature of said evaporator.

13. The control apparatus according to claim 9, further comprising a means for magnifying the differential pressure between the two pressure monitoring points, the means arranged between the two pressure monitoring points.

14. The control apparatus according to claim 13, wherein said means is a fixed throttle.

15. The control apparatus according to claim 9, wherein said compressor is a swash plate type variable displacement compressor in which stroke of a piston can be changed by controlling an internal pressure of a crank chamber.

16. The control apparatus according to claim 9, wherein said compressor is a wobble type variable displacement compressor in which stroke of a piston can be changed by controlling an internal pressure of a crank chamber.

17. A method for controlling discharge capacity of a variable displacement compressor included in a refrigeration circuit of an air conditioner, said refrigeration circuit including an evaporator, said method comprising the steps of:

detecting a differential pressure between two pressure monitoring points set to said refrigeration circuit, on which the discharge capacity of the variable displacement compressor is reflected;

detecting a cooling state of said evaporator as temperature information;

calculating a set differential pressure which becomes a control target of a differential pressure between the two pressure monitoring points based on said temperature information and a target temperature which is a control target of the temperature of said evaporator;

setting a limit value to the differential pressure between the two pressure monitoring points when said temperature information is lowered from the state higher than a threshold temperature which is set to higher than the target temperature to the state lower than the threshold temperature, and releasing the setting of the limit value when the detected temperature is raised from the state lower than the threshold temperature to the state higher than the threshold temperature;

comparing said set differential pressure with the limit value set, dealing with the set differential pressure in itself if the discharge capacity of the variable displacement compressor which the set differential pressure represents is less than that of the variable displacement compressor which the limit value represents, and dealing with the limit value as a new set differential pressure if the discharge capacity of the variable displacement compressor which the set differential pressure represents is greater than that of variable displacement compressor which the limit value represents; and controlling the discharge capacity of the variable displacement compressor so that the differential pressure approaches to said set differential pressure.

18. The control method according to claim 17, wherein said threshold temperature comprises an upper limit temperature and a lower limit temperature which are different from each other, wherein said step of setting or releasing said limit value includes the step of setting the limit value to the differential pressure between the two pressure monitoring points when the temperature information from said evaporator is lowered from the state higher than the lower limit temperature to the state lower than the lower limit temperature, and releasing the setting of the limit value when the detected temperature is raised from the state lower than the upper limit temperature to the state higher than the upper limit temperature.

19. The control method according to claim 17, wherein said step of detecting a cooling state of said evaporator as temperature information detects the temperature of air passed through the evaporator.

20. The control method according to claim 17, wherein the target temperature of said evaporator can be adjusted.

* * * * *